US010035059B2

(12) United States Patent
Chen et al.

(10) Patent No.: US 10,035,059 B2
(45) Date of Patent: Jul. 31, 2018

(54) FLAT GROUND CROSS-COUNTRY TYPE ROLLER SKATE

(71) Applicants: Yongmei Chen, Yuyao (CN); Yongping Chen, Yuyao (CN)

(72) Inventors: Yongmei Chen, Yuyao (CN); Yongping Chen, Yuyao (CN)

( * ) Notice: Subject to any disclaimer, the term of this patent is extended or adjusted under 35 U.S.C. 154(b) by 0 days.

(21) Appl. No.: 15/549,672

(22) PCT Filed: Feb. 14, 2016

(86) PCT No.: PCT/CN2016/000078
§ 371 (c)(1),
(2) Date: Aug. 9, 2017

(87) PCT Pub. No.: WO2016/127730
PCT Pub. Date: Aug. 18, 2016

(65) Prior Publication Data

US 2018/0028899 A1 Feb. 1, 2018

(30) Foreign Application Priority Data

Feb. 13, 2015 (CN) ..... 2015 1 0075044

(51) Int. Cl.
*A63C 17/04* (2006.01)
*A63C 17/22* (2006.01)
*A63C 17/00* (2006.01)

(52) U.S. Cl.
CPC ..... *A63C 17/226* (2013.01); *A63C 17/008* (2013.01); *A63C 17/0046* (2013.01); *A63C 17/04* (2013.01)

(58) Field of Classification Search
CPC . A63C 17/226; A63C 17/0046; A63C 17/008; A63C 17/0073; A63C 17/04; A63C 17/016
USPC ..... 280/11.28, 11.221, 11.225
See application file for complete search history.

(56) References Cited

U.S. PATENT DOCUMENTS

| | | | | |
|---|---|---|---|---|
| 6,012,727 | A * | 1/2000 | Chang | A63C 17/0046 280/11.223 |
| 9,149,712 | B2 * | 10/2015 | Hering | A63C 17/0006 |
| 2016/0038824 | A1 * | 2/2016 | Choudhary | A63C 17/062 280/11.207 |

FOREIGN PATENT DOCUMENTS

| | | | |
|---|---|---|---|
| CN | 2124736 | U | 12/1992 |
| CN | 2410009 | Y | 12/2000 |
| CN | 2431925 | Y | 5/2001 |
| CN | 2439882 | Y | 7/2001 |
| CN | 104606870 | A | 5/2015 |
| CN | 104606871 | A | 5/2015 |
| CN | 204447237 | U | 7/2015 |
| CN | 204582510 | U | 8/2015 |

(Continued)

*Primary Examiner* — John Daniel Walters
(74) *Attorney, Agent, or Firm* — Gokalp Bayramoglu

(57) ABSTRACT

The present invention discloses a flat ground cross-country type roller skate comprising a skate body (1), wherein a wheel assembly at a lower part of the skate body, wherein the wheel assembly comprises a mounting seat (6) used to mount the skate body (1) and a hoisting mechanism disposed on the mounting seat (6). There are at least three wheel assemblies disposed on the hoisting mechanism, and each wheel assembly can hoist independently under the action of the hoisting mechanism. Thus, the wheel assemblies of the roller skate can be hoisted independently so as to adapt to various roads with uneven surface.

8 Claims, 8 Drawing Sheets

(56) References Cited

FOREIGN PATENT DOCUMENTS

| | | | | | |
|---|---|---|---|---|---|
| GB | 2336320 | B | | 3/2000 | |
| TW | 165322 | | | 8/1991 | |
| WO | WO-2014174530 | A2 | * | 10/2014 | ..... A63C 17/0046 |

* cited by examiner

FLAT GROUND CROSS-COUNTRY TYPE ROLLER SKATE

CROSS REFERENCE TO RELATED APPLICATIONS

This application is the national phase entry of International Application No. PCT/CN2016/000078, filed on Feb. 14, 2016, which is based upon and claims priority to Chinese Patent Application No. CN201510075044.5, filed on Feb. 13, 2015, the entire contents of which are incorporated herein by reference.

FIELD OF THE INVENTION

The present invention relates to a roller skate, more particularly, to a roller skate with function of flat ground cross-country.

BACKGROUND

Roller skate, commonly known as skates, ice skates, comprising a skate body and a wheel assembly is a product combining entertainment with fitness and is popular with many people, especially youngsters, while having numerous applications. Currently the wheel of the roller skates in market is not fixed, cannot be adjusted up and down and only skids on a plat ground, therefore the wheel cannot cross once an uneven ground is encountered thereby leading to great security risks. It is necessary to improve against such a structure of the present roller skates by allowing the roller skates to adapt to an uneven ground, so as to increase the flexibility and experience for its use.

SUMMARY

The present invention provides an improved roller skates against the lack in prior art, which can adapt to the uneven ground, thus extending the use range of the traditional roller skates.

The present is realized by the following technical schemes.

A flat ground cross-country type roller skate comprising a skate body, wherein a wheel assembly is arranged at a lower part of the skate body, wherein the wheel assembly comprises a mounting seat used to mount the skate body, a hoisting mechanism disposed on the mounting seat, wherein at least three wheel assemblies are disposed on the hoisting mechanism, and each wheel assembly can be hoisted independently under the action of the hoisting mechanism.

Traditional roller skate comprises a body on upper portion and a wheel assembly on lower portion, wherein a plurality of single row or double row wheels arranged regularly are provided on the bottom of the wheel assembly; the positions of these wheels are fixed, that is to say, these wheels cannot adjust its respective positions according to the level of the ground; therefore the traditional roller skates can only be used on a flat ground, which limits its use.

The roller skates of the present invention can adapt to the uneven ground in traveling direction through improvement, so it is called "flat ground cross-country" roller skates.

Preferably, the hoisting mechanism comprises a first connecting rod, wherein a first end of the first connecting rod is provided with a first wheel assembly and a second end of the first connecting rod is movably connected to a second connecting rod; both ends of the second connecting rod are provided with a second wheel assembly and a third assembly respectively; and the first connecting rod and the second connecting rod can rotate around the joints thereof respectively.

Specifically, the wheel assembly on the bottom of the roller skates of the present invention is fixed on one end of the first connecting rod and both ends of the second connecting rod, while the middle of the second connecting rod is connected with another end of the first connecting rod. Since the first connecting rod and the second connecting rod can rotate around their joint respectively, these wheel assemblies, in use, can hoist adaptively according to the level of the ground such that the roller skates can be used on the complex uneven ground.

Preferably, one end of the first connecting rod is connected with the second connecting rod through a transition block, thereby increasing the flexibility of the wheel assembly in use.

Preferably, the first connecting rod is provided with a first limit mechanism to prevent an excessive rotation angle thereof, in use, the roller skates of the present invention achieve the hoisting of the wheel assembly through the rotation of the connecting rods when meeting barriers so as to pass cross the barriers. In such process, an excessive rotating angle of the first connecting rod may cause damage of the first connecting rod and bears insecure factors, so provision of the first limit mechanism can avoid an excessive rotating angle. The first limit mechanism can be a projecting component disposed on the first connecting rod or serving as other arrangements for reducing rotating angle.

Likewise, further preferably, the second connecting rod is also provided is provided with a second limit mechanism to prevent an excessive rotation angle thereof. The specific realizing way and function are similar to the first limit mechanism.

Preferably, the first connecting rod is connected pivotally with the second connecting rod at their joint to facilitate relative rotation.

In another preferred scheme of the present invention, the hoisting mechanism comprises a first mount block; a spring is disposed on the first mount block; the end part of the spring is mounted with a wheel assembly by a second mount block. Through the retraction of the spring, such structure can achieve the hoisting of the second mount block, and further achieve the hoisting of the spring to allow the roller skates to pass across the uneven barriers on the ground.

Compared with the prior art the present invention has the following beneficial effects: 1) the wheel assembly of the roller skates can hoist independently to thus adapt to various uneven ground; 2) the roller skate has a good stability and high security.

DETAILED DESCRIPTION OF THE EMBODIMENTS

Implementations of the present invention will be further described in detail in combination with drawings and specific embodiments.

Figure 1:
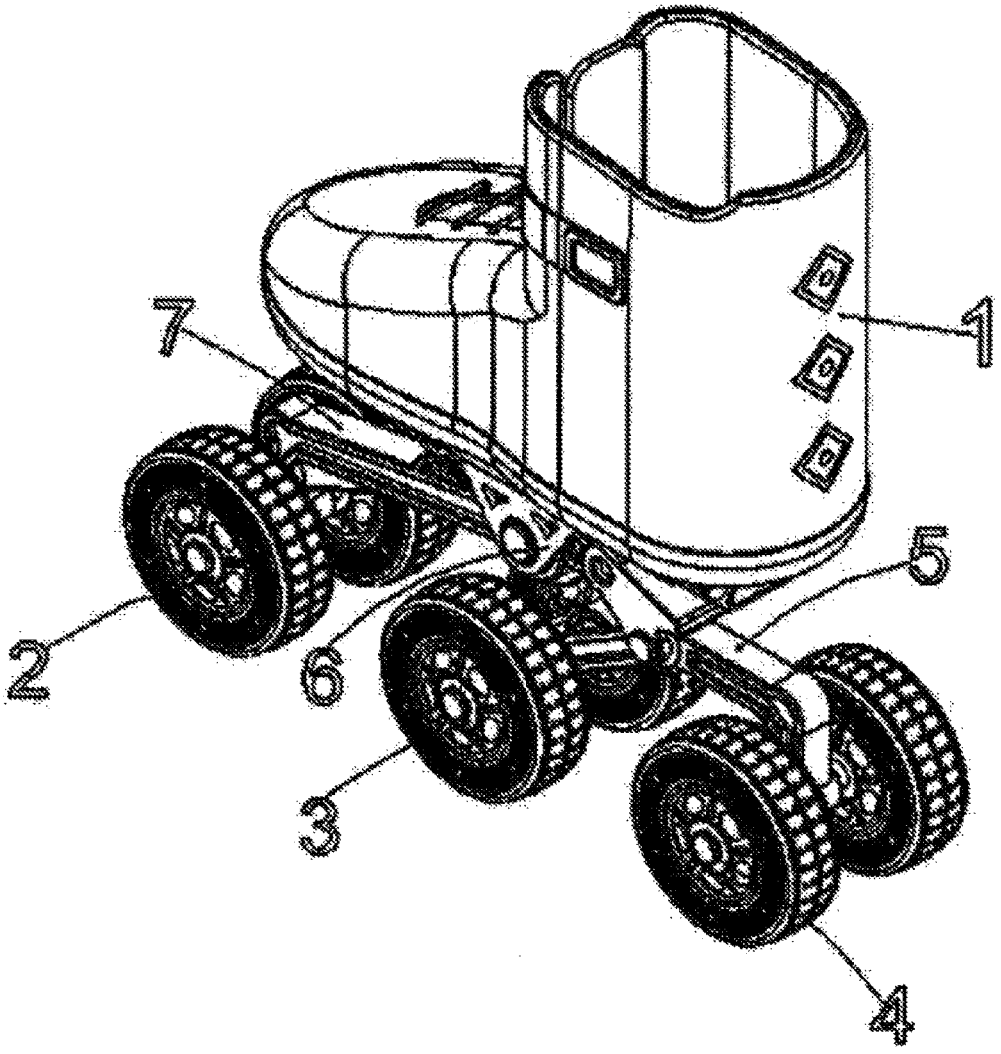
FIG. 1 is a stereoscopic view of the invention.
Figure 2:
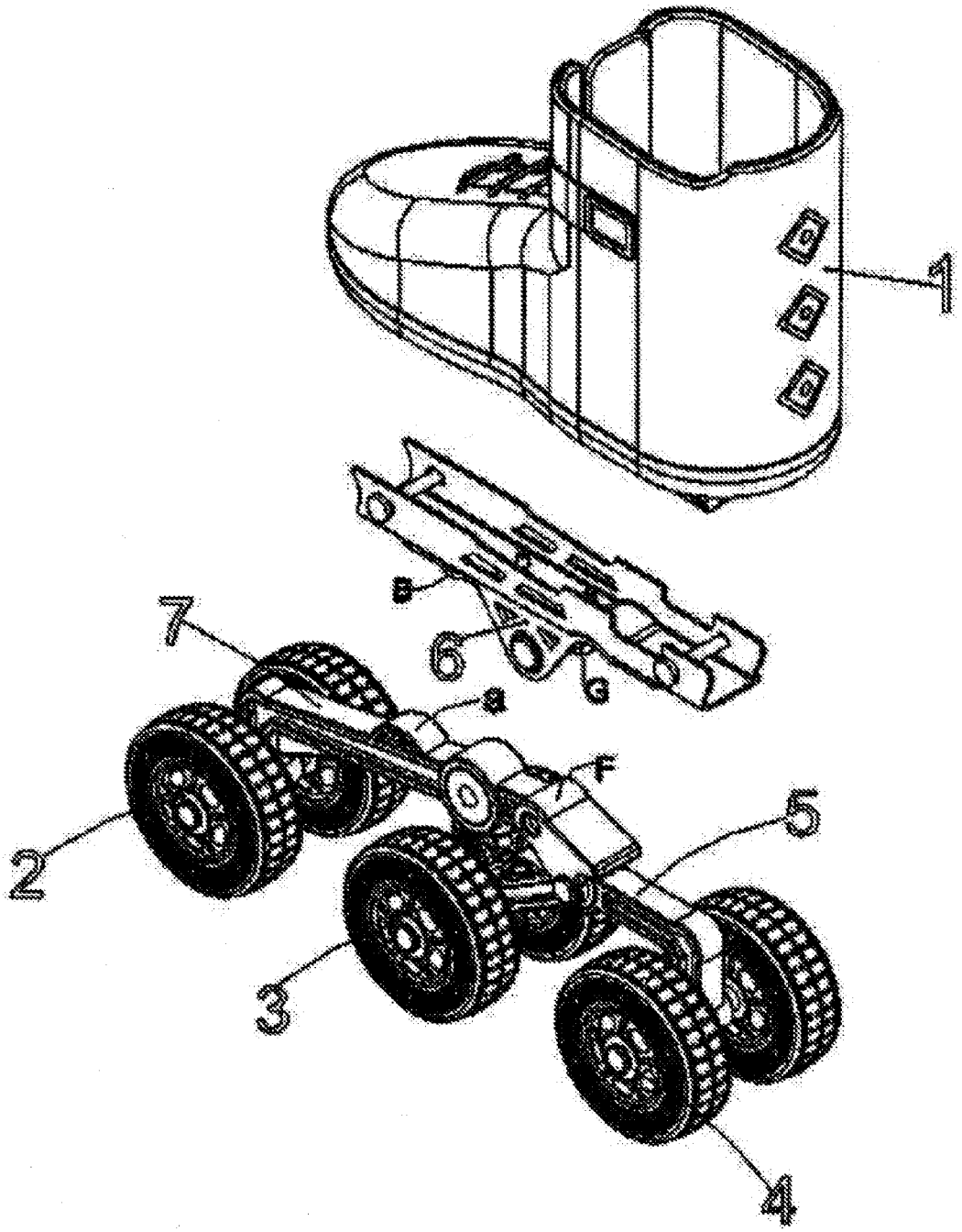
FIG. 2 is an exploded view of the invention.
Figure 3:
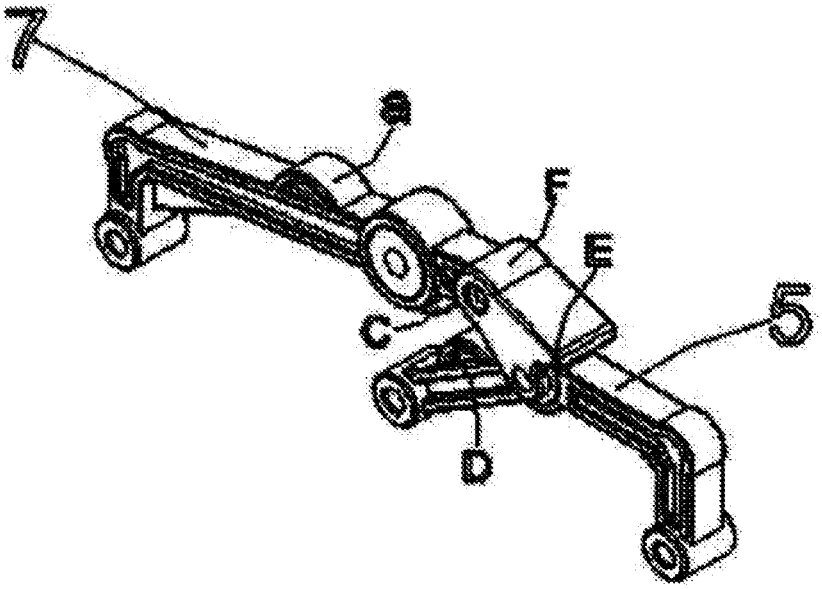
FIG. 3 is a stereoscopic view of the first connecting rod and second connecting rod.

With reference to FIG. 1 to 4, a flat ground cross-country type roller skate comprising a skate body 1 which is arranged with a wheel assembly at the lower part, wherein the wheel assembly comprises a mounting seat 6 used to mount the skate body 1; one end of the first connecting rod 7 is provided with a first wheel assembly 2 and another end is connected with a second connecting rod 5 through a transition block F, that is to say, one end of the transition block F is pivotally connected with the first connecting rod 7 and another end is pivotally connected with the second connecting rod 5; both ends of the second connecting, rod 5 are provided with a second wheel assembly 3 and a third wheel assembly 4 respectively, and the first connecting rod 7 is connected pivotally with the second connecting rod 5 at their joint, i.e. at a first pivoting portion C and a second pivoting porting E in FIG. 3, to be able to rotate around their joints respectively. Furthermore, a projecting part is provided on the second pivoting portion E to serve as a limit so as to increase stability.

In the present embodiment, a first limit mechanism, which is a first limit projection a, is disposed on the first connecting rod 7 to prevent an excessive rotation angle thereof, correspondingly, a second limit projection B capable of offsetting from the first limit projection a is disposed on the bottom of the mounting seat 6. In the present embodiment, a second limit mechanism, which is a third limit projection D, is disposed on the first connecting rod 5 to prevent an excessive rotation angle thereof, correspondingly, a fourth limit projection B capable of offsetting from the third limit projection a is disposed on the bottom of the first pivoting portion C.

Additionally, in use, the transition block can also move up and down, so a recess G that is matched with the formation of the transition block F is disposed on the corresponding position on the bottom of the mounting seat 6 to serve as a positioning element so as to increase stability.

Figure 4:
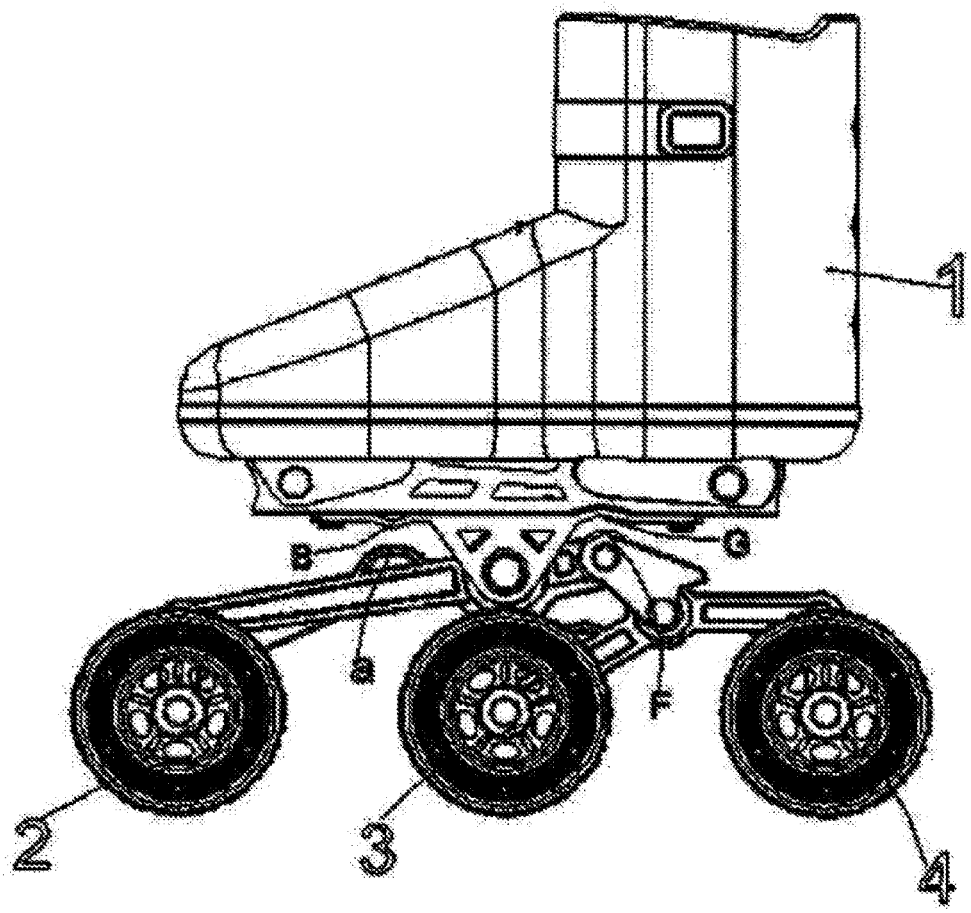
FIG. 4 is a side view of the invention.
Figure 5:
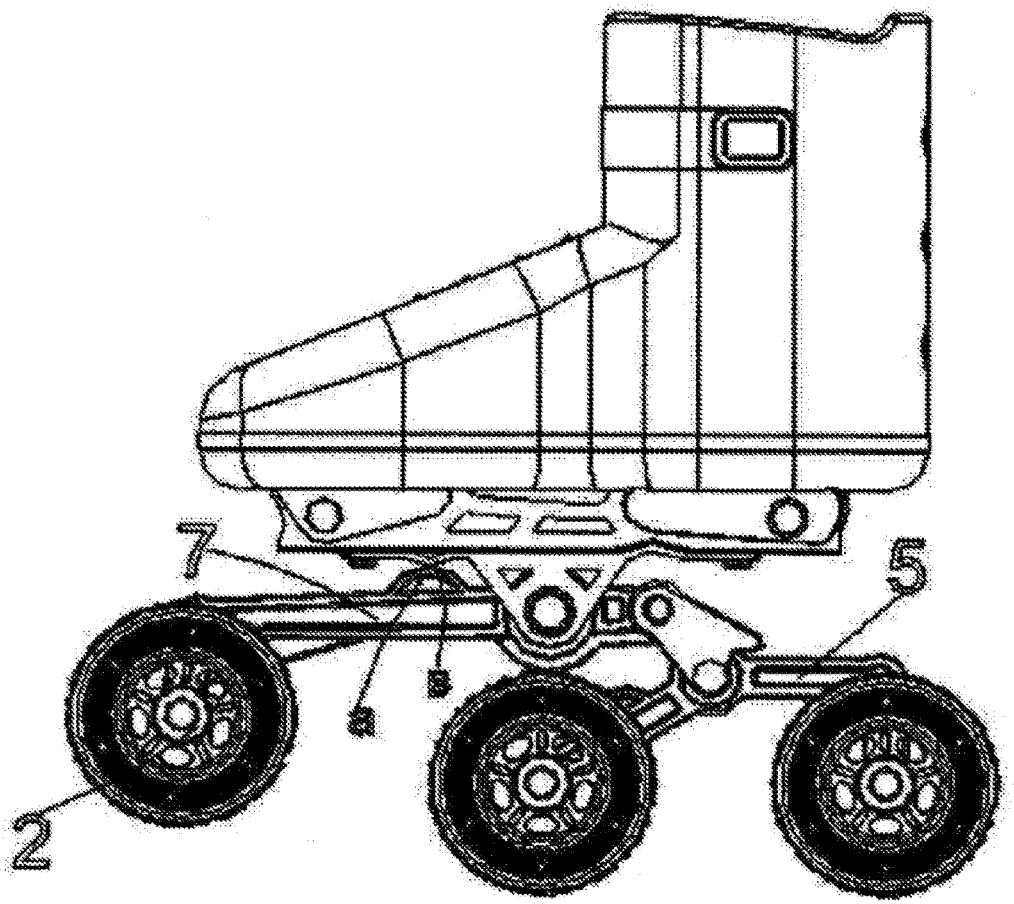
FIG. 5 is a view of the tilted first wheel, assembly.
Figure 6:
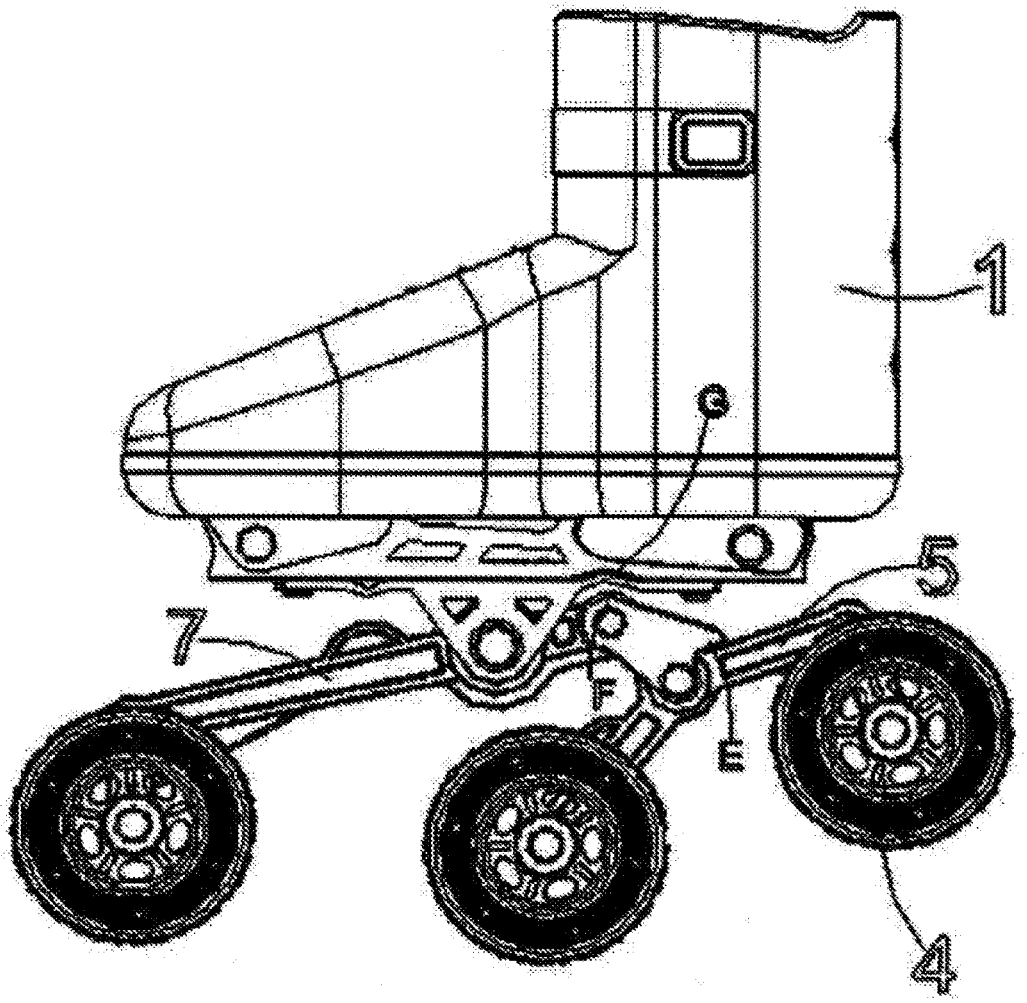
FIG. 6 is a view of the tilted third wheel assembly.
Figure 7:
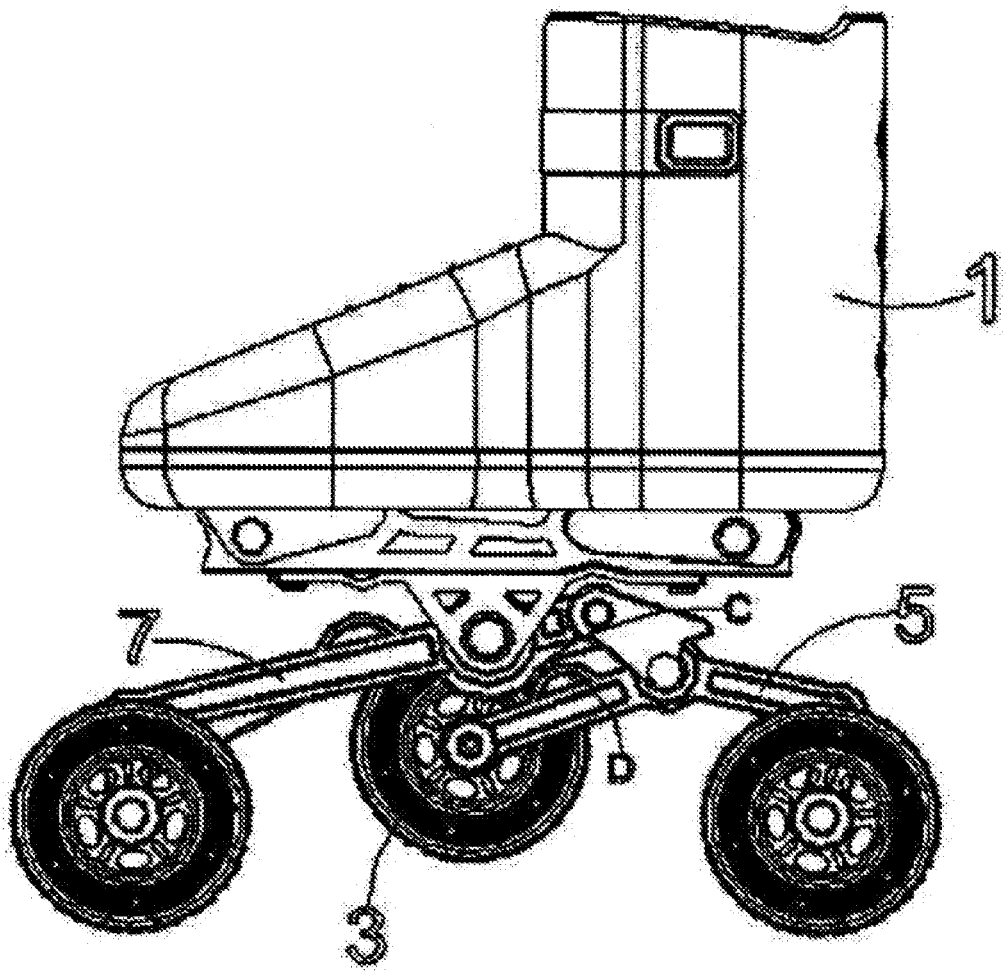
FIG. 7 is a view of the tilted second wheel assembly.

As independent hoisting of the wheel assembly of the roller skates in the present invention, it can be used on the uneven ground in traveling direction. Above functions can be better seen from FIGS. 4 to 7: FIG. 4 is a status view of the wheels when used on a flat ground, FIG. 5 is a status view of the hoisted first wheel assembly 2 when encountered with barriers, FIG. 6 is a status view of the hoisted third wheel assembly 4, FIG. 7 is a status view of the hoisted second wheel assembly 3.

Figure 8:
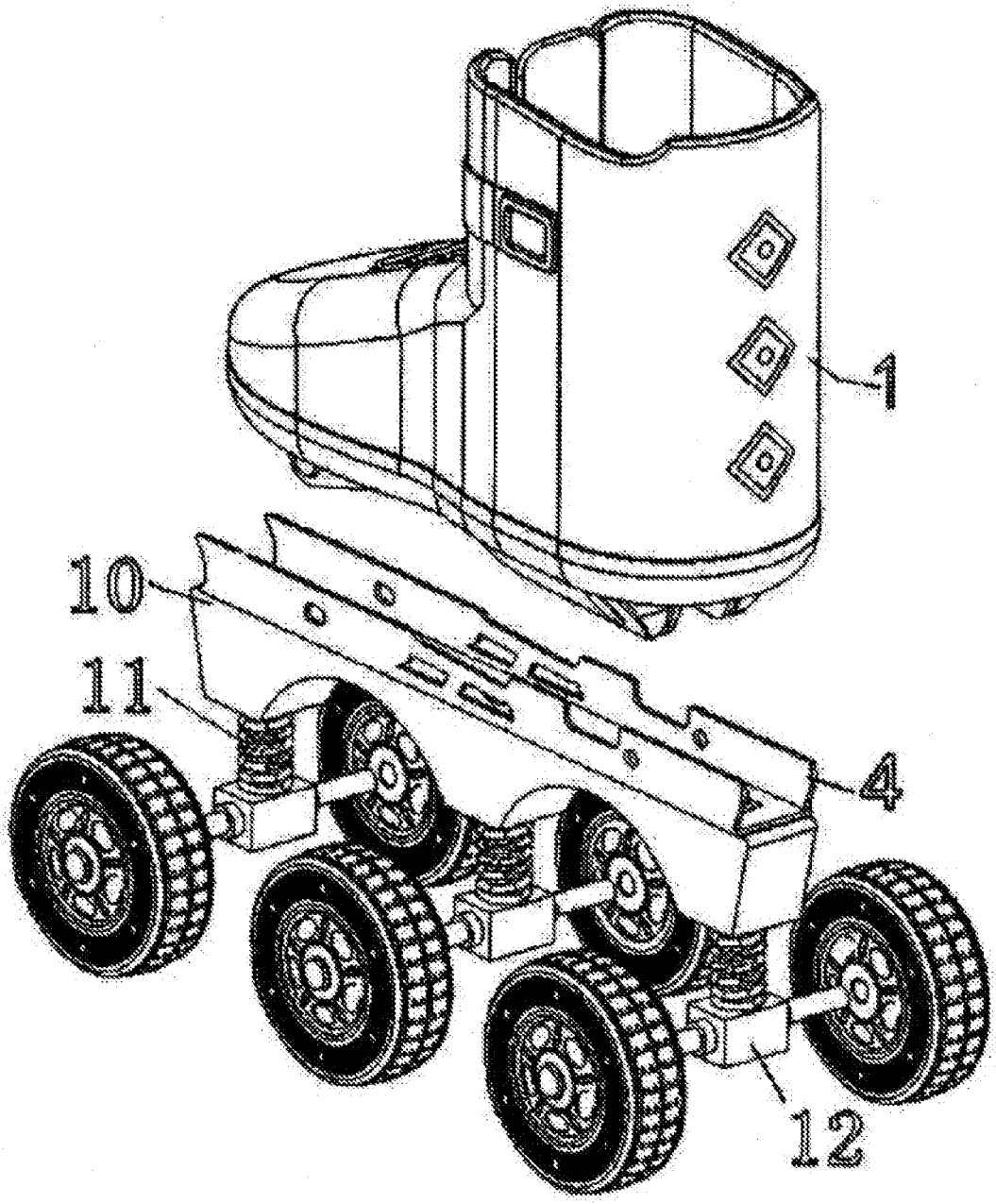
FIG. 8 is an exploded view of another embodiment.

With reference to FIG. 8, an exploded view of another embodiment of the present invention is shown. In the present embodiment, the hoisting mechanism comprises a first mount block 10; three springs 11 are disposed on the lower part of the first mount block 10; the end parts of the three springs 11 are provided a second mount block. 12, both ends of the second mount block 12 being mounted symmetrically with wheels. Thus the second mount block 12 can independently hoist by the elasticity of the spring 11, thereby allowing the wheel assembly of the second mount block 12 to hoist up and down so try to make the roller skates use on the uneven ground.

The protective scope of the present invention includes, but is not limited to, above embodiments; the scope of the present invention is based on the scope of the claims, and any alternatives, modifications and improvements that may be readily apparent to those skilled in the art in the art are within the scope of the protection range of the present invention.

We claim:

1. A flat ground cross-country type roller skate comprising: a skate body, wherein a wheel assembly is arranged at a lower part of the skate body, wherein the wheel assembly comprises a mounting seat used to mount the skate body, a hoisting mechanism disposed on the mounting seat, wherein at least three wheel assemblies are disposed on the hoisting mechanism, and each wheel assembly is hoisted independently under the action of the hoisting mechanism; and wherein the hoisting mechanism comprises a first connecting rod, wherein a first end of the first connecting rod is provided with a first wheel assembly and a second end of the first connecting rod is movably connected to a second connecting rod; wherein both ends of the second connecting rod are provided with a second wheel assembly and a third assembly respectively; wherein the first connecting rod and the second connecting rod are capable of rotating around the joints a first joint and a second joint thereof respectively.

2. The flat ground cross-country type roller skate according to claim 1, wherein the second end of the first connecting rod is connected to the second connecting rod through a transition block.

3. The flat ground cross-country type roller skate according to claim 2, wherein the first connecting rod is provided with a first limit mechanism to prevent an excessive rotation angle of the first connecting rod.

4. The flat ground cross-country type roller skate according to claim 3, wherein one end of the second connecting rod is provided with a second limit mechanism to prevent an excessive rotation angle of the second connecting rod.

5. The flat ground cross-country type roller skate according to claim 2, wherein one end of the second connecting rod is provided with a second limit mechanism to prevent an excessive rotation angle of the second connecting rod.

6. The flat ground cross-country type roller skate according to claim 2, wherein the first connecting rod and the second connecting rod are pivotally connected at the first joint and the second joint.

7. The flat ground cross-country type roller skate according to claim 1, wherein the first connecting rod and the second connecting rod are pivotally connected at the first joint and the second joint.

8. The flat ground cross-country type roller skate according to claim 1, wherein the hoisting mechanism comprises a first mount block; wherein a spring is disposed on the first mount block; wherein an end part of the spring is mounted with a wheel assembly by a second mount block.

* * * * *